United States Patent [19]

Lewis et al.

[11] Patent Number: 4,853,114

[45] Date of Patent: Aug. 1, 1989

[54] METHOD FOR THE DEPRESSING OF HYDROUS, LAYERED SILICATES

[75] Inventors: Norman J. Lewis, Lisvane Cardiff, Wales; Hans P. Panzer, Stamford, Conn.

[73] Assignee: American Cyanamid Company, Stamford, Conn.

[21] Appl. No.: 318,789

[22] Filed: Mar. 3, 1989

[30] Foreign Application Priority Data

Apr. 5, 1988 [ZA] South Africa ..... 88/2394

[51] Int. Cl.[4] ..... B03D 1/02

[52] U.S. Cl. ..... 209/167; 423/26

[58] Field of Search ..... 209/166, 167; 252/61; 423/26

[56] References Cited

U.S. PATENT DOCUMENTS 1,771,549 7/1930 Phelan ..... 209/167
2,919,802 1/1960 Drake ..... 209/167
3,607,394 9/1971 Germino ..... 209/167
3,862,028 1/1975 Jones ..... 209/167

FOREIGN PATENT DOCUMENTS 1456392 9/1973 United Kingdom ..... 209/167

OTHER PUBLICATIONS

Kirk Othmer Encyc. of Chem. Tech.-3rd Edition, pp. 535-555, "Carbohydrates" by Roy Whister & John Zysk.

*Primary Examiner*—Kenneth M. Schor
*Assistant Examiner*—Thomas M. Lithgow
*Attorney, Agent, or Firm*—Frank M. Van Riet

[57] ABSTRACT

A process for the recovery of mineral values from base metal ores is disclosed. Specifically, a froth flotation process is disclosed which comprises contacting an aqueous ore slurry with an effective amount of hemicellulose, a mineral collector and a frothing agent.

7 Claims, No Drawings

METHOD FOR THE DEPRESSING OF HYDROUS, LAYERED SILICATES

BACKGROUND OF THE INVENTION

The present invention relates to a froth flotation process for the recovery of mineral values from base metal ores. More particularly, it relates to a new and improved process for beneficiating minerals by froth flotation incorporation a new class of depressants.

Certain theory and practice state that the success of a flotation process depends to a great degree on reagents called collectors that impart selective hydrophobicity to the mineral value which has to be separated from other minerals.

Certain other important reagents, such as the modifiers, are also largely responsible for the success of flotation separation of minerals. Modifiers include all reagents whose principal function is neither collecting nor frothing, but one of modifying the surface of the mineral so that a collector either adsorbs to it or does not. Modifying agents may thus be considered as depressants, activators, pH regulators, dispersants, deactivators, etc. Often, a modifier may perform several functions simultaneously.

In addition to attempts at making the collectors more selective for value minerals, other approaches to the problem of improving the flotation separation of value minerals have included the use of modifiers, more particularly depressants, to depress hydrous, layered silicates such as talc and other gangue minerals so that they do not float in the presence of collectors, thereby reducing the levels of non-value contaminants reporting to the concentrates. As has been mentioned above, a depressant is a modifier reagent which selectively prevents or inhibits adsorption of the collectors onto certain of the mineral particles surfaces present in the flotation slurry or pulp.

Hydrated silicates such as talc, i.e., is magnesium silicate, which, because of their crystalographic structure, *behave as a hydrophobic mineral when ground and slurried with water. The silicates therefore cause problems when associated with valuable minerals such as gold and platinum which are to be recovered by froth flotation. In the flotation of such hydrous, layered silicates as talc and pyrophyllite, depressants such as guar gum, starch, dextrin and carboxy methyl cellulose have been found to be useful commercially. Guar gum and carboxy methyl cellulose are the only two widely employed with the guar gum the most common depressant for talc by far. These conventional depressants, however, present a number of serious problems and have serious shortcomings attendant with their use. Guar gum, for example, is extremely difficult to dissolve and others are relatively expensive. Moreover, the conventional depressants are either non-selective or when used in sufficient quantities to provide good separation, provide economically unsatisfactory concentrates, i.e., the yield of value minerals is too low.

The beneficiation criteria for treating complex ores are maximum value metal and precious metals (if any) recovery and minimum contamination of the value concentrate by non-value hydrous, layered silicates such as talc. In many cases, these criteria cannot be met without seriously sacrificing value metals production or recovery. Therefore, there remains an urgent need for flotation reagents that can selectively depress reporting to the concentrate and concurrently provide economically acceptable recoveries of value minerals.

Unexpectedly, in view of the foregoing, it has now been discovered that hemicellulose is a very selective depressant for hydrous, layered silicates. The use of the hemicellulose of the present invention provides a substantial reduction in talc contamination in the mineral concentrates reporting to the smelters, and is more readily dissolved in water, i.e., it has a rapid hydration time, than guar gum and, because of its availability, it presents substantial cost reductions in the froth flotation of mineral values.

DESCRIPTION OF THE INVENTION

The present invention provides a new and improved method for the beneficiation of value minerals from ores with selective rejection of hydrous, layered silicates said method comprising:

(a) providing an aqueous pulp slurry of finely divided, liberated ore particles;

(b) conditioning said pulp slurry with an effective amount of hemicellulose, a mineral collector and a frothing agent;

(c) collecting the value mineral by froth flotation procedures.

The new and improved method for beneficiating value minerals by froth flotation procedures employing hemicellulose in accordance with this invention provides excellent metallurgical recovery with significant improvements in grade. The hemicellulose is effective over a wide range of pH and dosages. The hemicellulose is compatible with available frothers and mineral collectors and may be readily incorporated into any currently operating system or facility.

Hemicellulose is a polysaccharide extractable from plant substances such as by means of hot water, aqueous alkali etc.. It is mainly a heteropolymer, often short chain branched, of various sugars and may contain some uronic acids. The hemicellulose derived from larch wood; i.e., the arabinogalactan, is water-soluble. See Kirk Othmer, 3rd Edition, Vol. 4, Carbohydrates, pp 535–554. Hemicellulose extracted from such substrates as bagasse, bamboo, rice wheat straw, tropical hardwoods, slash pine, soybean hull, corn cob, beet pulp, hemlock, alfa-alfa stem, water hyacinth etc., and is also a by-product from the paper-making industry that is recovered from spent liquors, i.e., that fraction of black liquor and green liquor from the wood pulping process which can be precipitated out of solution with methanol or a similar solvent. A process for its recovery is disclosed in published South African application No. 872930, Apr. 24, 1987 and Cellul. Chem. Technol, 1982; Vol. 16; No. 3. K. Dimov et al, all of which are hereby incorporated herein by reference.

The present invention is specifically directed to the depression of hydrous, layered silicates such as talc during the froth flotation of such materials as copper ores, copper-molybdenum ores, complex ores containing lead, copper, zinc, silver, gold, etc., nickel and nickel-cobalt ores, gold ores and gold-silver ores etc. to facilitate copper-lead, lead-zinc, copper-zinc separations, etc.

The following examples are set forth for purposes of illustration only and are not to be construed as limitations on the present invention, except as set forth in the appended claims. All parts and percentages are by weight unless otherwise specified.

EXAMPLE 1

A flotation feed generated from the primary cyclone overflow of a mine operation and containing approximately 7.5 parts/ton of gold, 2% sulfur and a significant amount of talc as gangue is treated as follows:

A quantity of the overflow slurry is transferred to a suitable flotation cell such that the cell contains 2 parts of solids at a slurry density of 1.282 parts/cc. The slurry is sized at 50%-75 m. The slurry is agitated at a speed of 5.9 m/s. The pH of the slurry is 9.2. To the slurry are then added 100 parts/ton of copper sulfate, 40 parts/ton of commercially available promoter and 120 parts/ton of xanthate. The resultant mixture is conditioned for 2 minutes and 36 parts/ton of triethoxybutane frother and depressant (as indicated below) are added after which conditioning continues for 30 seconds. The slurry is then aerated and a flotation conducted for 1 minute, 1 minute, 2 minutes, 4 minutes and 4 minutes i.e., 12 minutes total flotation time producing five (5) concentrates and a flotation tail. The optimum dosage of a commercially available guar based depressant (designated GBD) is determined to be 150 parts/ton. The results are set forth in Table I, below. Hemicellulose is derived from bagasse black liquor and is designated HC.

TABLE I

| Depressant | Dosage (parts/ton) | Cumulative Grade % Gold (p/t) | S | MgO | Cumulative Recovery % Gold | S | MgO |
|---|---|---|---|---|---|---|---|
| GBD | 150 | 86.06 | 7.43 | 13.02 | 57.89 | 65.23 | 4.57 |
| HC | 225 | 86.04 | 7.49 | 13.92 | 58.66 | 67.59 | 4.52 |
| HC | 250 | 88.96 | 8.06 | 12.51 | 58.42 | 68.02 | 4.29 |
| HC | 275 | 101.63 | 9.08 | 12.65 | 57.18 | 66.15 | 3.73 |
| HC | 400 | 116.58 | 10.97 | 9.22 | 52.49 | 60.12 | 2.93 |
| HC | 600 | 126.30 | 10.99 | 8.43 | 54.40 | 62.60 | 2.82 |

From the above, it is evident that hemicellulose results in the attainment of higher gold grades at all dosages above 225 parts/ton and higher gold recoveries at 225 and 250 parts/ton. MgO grades are lower at all dosages above 225 parts/ton and MgO recoveries are lower at all dosages. 250 Parts/ton appear to be optimum for this feedstock, the cost of guar based depressant being 60% more expensive.

EXAMPLE 2

A 1000 part charge of crushed ore containing about 0.15% nickel, 3.4 parts/metric ton of platinum group metals and gold and considerable talc is ground in a rod mill with 350 parts of tap water for 25 minutes to achieve a grind of 66% passing 74 microns. The ground slurry is transferred to a suitable stainless steel Denver flotation cell and the water level made up with tap water. 0.4 Part of 10% copper sulfate is added to the slurry and the resultant mixture is agitated using a Denver D12 mechanism at 1000 rpm for 7 minutes. 130 Parts/ton of sodium normal propyl xanthate (2% solution in water) are added and agitation is continued for another 5 minutes. At this stage, depressant is added as a 1% solution in water immediately followed by a standard volume of frother with another minute of agitation. 6 Liters/minute of air is then applied to the cell and a flotation concentrate is collected for 1 minute. The air is switched off, agitation is continued for 30 seconds, air is switched on and a second concentrate is collected for 3 minutes. The air is again switched off, agitation is continued for 30 seconds, air is switched on and a third concentrate is collected for 4 minutes. Concentrates and tails are filtered, dried and assayed for platinum group metal and gold. The recovery and grade are calculated from the weights and assays. The results are set forth in Table II, below. HC is hemicellulose (as in Example 1) and CMC is carboxymethyl cellulose.

TABLE II

| Depressant | Dosage Parts/Ton | Cumulative Mass % 1st Conc. | 2nd Conc. | Total | Cumulative PGM and Gold Recovery 1st Conc | 2nd Conc | Total | Cumulative PGMGR 1st Conc | 2nd Conc. | Total |
|---|---|---|---|---|---|---|---|---|---|---|
| CMC | 300 | 2.01 | 5.14 | 6.96 | 51.76 | 68.62 | 72,23 | 131.32 | 68.11 | 52.95 |
| HC | 300 | 2.16 | 4.97 | 7.04 | 55.22 | 72.06 | 76.67 | 130.42 | 73.99 | 55.51 |
| HC | 500 | 1.62 | 3.35 | 4.77 | 53.54 | 65.35 | 69.22 | 168.29 | 99.64 | 73.99 |

PGM = Platinum Group Metals
PGMGR = Platinum Group Metals Grade

As can be readily appreciated, at an equivalent dosage, a higher platinum group metal recovery is achieved with hemicellulose at a higher overall grade than with carboxymethyl cellulose.

EXAMPLE 3

A 1000 part charge of ore containing 0.7% nickel, (0.56% of which is present as sulfide nickel, the remaining being associated with carbonate, oxide and silicate) is ground with 700 parts of water, 50 parts/ton of potassium amyl xanthate (1% solution), 40 parts/ton of copper sulfate (110% solution) and 40 parts of 0.5% ammonium hydroxide. The grind produces a flotation feed of 73.4% passing 75 microns at pH 9.53.

The slurry is washed into a suitable stainless steel flotation cell and topped with water prior to agitation with a Denver D12 flotation mechanism. 20 Parts/ton of potassium amyl xanthate are added to the cell and the whole agitated at 1500 rpm for 1 minute. 100 Parts/ton of triethoxybutane added as a frother and conditioned for 30 seconds. 260 Parts/ton of depressant are added conditioned for a further 30 seconds. Air is introduced into the cell at 5 liters/minute, with continued agitation at 1500 rpm, and a flotation concentrate is collected for 4 minutes. The air switched off, 10 parts/ton of potassium amyl xanthate are added and conditioned for 1 minute. 10 Parts/ton of copper sulfate are added and conditioned for 30 seconds and 65 parts/ton of depressant are added with conditioning for 30 seconds. The air is switched on and a second concentrate is collected for 4 minuts. The air is switched off, 10 parts/ton of potassium amyl xanthate are added and, conditioned for 1 minute after which 10 parts/ton of copper sulfate are added with another minute of conditioning. The air is switched on and a third concentrate is collected for 4 minutes. Concentrates and tailings are filtered, dried and assayed for nickel. Recovery and grade for nickel are calculated. The results are set forth in Table III, below. GG is the designation for guar gum and HC designates hemicellulose derived from bagasse.

TABLE III

| Depressant | Dosage Parts/ton | Weight % C1 | Weight % C2 | Weight % C3 | Cumulative Nickel Recovery % C1 | Cumulative Nickel Recovery % C2 | Cumulative Nickel Recovery % C3 | Cumulative Nickel Grade C1 | Cumulative Nickel Grade C2 | Cumulative Nickel Grade C3 | Calc. Head NI % |
|---|---|---|---|---|---|---|---|---|---|---|---|
| GG | 325 | 11.48 | 3.94 | 3.03 | 46.53 | 56.80 | 60.71 | 2.86 | 2.60 | 2.32 | 0.71 |
| GG | 325 | 11.00 | 3.10 | 3.32 | 45.57 | 55.15 | 60.08 | 2.91 | 2.75 | 2.42 | 0.70 |
| HC | 500 | 11.33 | 2.42 | 4.13 | 42.97 | 51.48 | 58.52 | 2.76 | 2.63 | 2.32 | 0.73 |
| HC | 800 | 9.27 | 3.16 | 2.39 | 40.28 | 49.66 | 54.58 | 3.16 | 2.80 | 2.60 | 0.73 |
| HC | 325 | 15.22 | 2.84 | 279 | 44.59 | 52.91 | 57.35 | 2.12 | 2.12 | 1.99 | 0.72 |
| HC | 325 | 12.83 | 2.76 | 3.24 | 40.40 | 49.78 | 55.74 | 2.31 | 2.34 | 2.17 | 0.73 |
| HC | 325 | 14.46 | 4.94 | 0.00 | 39.38 | 53.29 | 53.29 | 2.02 | 2.04 | 2.04 | 0.74 |

C = Concentrate number

The above data indicate that a dosage of 500 parts/-ton of hemicellulose behaves in a similar fashion to the standard (325 parts/ton) dosage of guar gum.

These tests show that hemicellulose at a dose of about 250 parts/ton is an equivalent depressant to the standard guar gum at a dose of 150 parts/ton.

EXAMPLE 4

Following the procedure of Example 1, a second sample of the same cyclone overflow from the same ore is treated with varying dosages of hemicellulose derived from bagasse. The results are set forth in Table IV, below.

TABLE IV

| Test No. | Depressant & Dosage | Cumulative Gold Rec. % | Cumulative MgO | Gold Grade % |
|---|---|---|---|---|
| 1 | Hemicellulose 750 parts/ton | 50.3 | 5.0 | 7.8 |
| 2 | Hemicellulose 500 parts/ton | 44.0 | 4.3 | 9.3 |
| 3 | Hemicellulose 375 parts/ton | 56.6 | 20.3 | 15.0 |
| 4 | Hemicellulose 250 parts/ton | 54.3 | 14.3 | 17.2 |
| 5 | Standard #1 250 parts/ton | 59.5 | 6.1 | 12.4 |
| 6 | Standard #2 250 parts/ton | 56.6 | 6.7 | 9.4 |

EXAMPLE 5

Hemicellulose is tested as a depressant for pyrophyllite where the subject mineral occurs as free floating gangue when old gold mine tailings are reprocessed by froth flotation to recover gold and pyrite. The test procedure is as follows:

Fresh flotation plant feed which is conditioned with acid to pH 3.5 is transferred to a pachuca and the specific gravity adjusted to 1.325. 8 Liters of slurry is transferred to a D12 Denver flotation cell (4.16 kg dry solids). The slurry is agitated with the Denver mechanism at 1550 rpm to reagent addition. 85 Parts/ton of a 2-mercaptobenzothiazole are added to the cell and conditioned with no air for 60 seconds. Depressant is added at the dosage indicated and conditioning is continued for an additional 30 seconds. 45 Parts/ton each of $CuSO_4$ activator and polypropyleneglycol ether type frother are added and conditioning is continued for 30 seconds. Air is then applied and three flotation concentrates are collected for 2 minutes, 3 minutes and 4 minutes, respectively. Concentrates and tails are dried, weighed and assayed for gold and sulfur. The results are set forth in Table V, below.

TABLE V

| Test No. | Depressant Dosage | Mass | Cumulative S Grade % R1 | Cumulative S Grade % R2 | Cumulative S Grade % R3 | Cumulative Gold Rec % R1 | Cumulative Gold Rec % R2 | Cumulative Gold Rec % R3 | Cumulative S Rec % R1 | Cumulative S Rec % R2 | Cumulative S Rec % R3 | Head (calc) |
|---|---|---|---|---|---|---|---|---|---|---|---|---|
| 1 | G.G. - 85 parts/ton | 2.93 | 37.97 | 30.48 | 22.56 | 33.34 | 50.96 | 58.94 | 62.33 | 82.24 | 89.48 | 1.13 |
| 2 | HC - 100 parts/ton | 4.64 | 32.66 | 21.95 | 15.24 | 30.29 | 48.15 | 55.58 | 56.81 | 79.75 | 86.08 | 1.64 |
| 3 | HC - 170 parts/ton | 3.93 | 38.36 | 22.83 | 17.18 | 26.90 | 49.22 | 55.18 | 63.34 | 82.93 | 87.53 | 1.18 |

GG = Guar Gum - commercially available standard
HC = Hemicellulose derived from bagasse The above tests show that hemicellulose is somewhat less powerful than guar gum in this application, i.e., more mass is floating with hemicellulose at 100 parts/-ton. This results in lower sulfur grades for the standard in the first concentrate, however a higher dosage of hemicellulose does reduce the mass floating and improves sulfur grade and recovery. For gold, the recoveries are substantially equivalent and any difference may be attributed to variations in calculated head grade.

EXAMPLES 6–11

A nickel ore is treated in accordance with Example 3 except that 650 parts per ton of hemicellulose derived from a variety of sources is utilized as the depressant. The results, as compared to the standard guar gum at 325 parts per ton are set forth in Table VI, below.

TABLE VI

| Example | Hemicellulose Derived from | Cumulative Ni Recovery-% C1 | Cumulative Ni Recovery-% C2 | Cumulative Ni Recovery-% C3 | Cumulative Nickel Grade C1 | Cumulative Nickel Grade C2 | Cumulative Nickel Grade C3 |
|---|---|---|---|---|---|---|---|
| A | Guar Gum | 45.7 | 54.6 | 59.5 | 6.0 | 5.2 | 4.3 |
| 6 | Bagasse | 44.5 | 54.8 | 60.7 | 6.9 | 6.0 | 5.0 |
| 7 | Alfa-Alfa stem | 42.6 | 52.0 | 54.9 | 4.8 | 4.2 | 4.0 |
| 8 | Water hyacinth | 33.0 | 48.0 | 57.0 | 9.3 | 8.0 | 6.5 |
| 9 | Corn Cob | 42.5 | 54.8 | — | 1.6 | 1.7 | — |
| 10 | Beet pulp | 53.0 | 63.9 | 68.1 | 2.2 | 2.2 | 2.1 |
| 11 | Eastern hemlock | 45.1 | 54.8 | 60.2 | 5.2 | 4.6 | 4.0 |

We claim:

1. A method for the beneficiation of value minerals from an ore containing said value minerals and hydrous, layered silicates with selective rejection of said hydrous, layered silicates which comprises:

(a) providing an aqueous pulp slurry of finely-divided, liberated ore particles;

(b) conditioning said pulp slurry with an effective amount of hemicellulose to selectively depress said hydrous, layered silicates, a mineral collector and a frothing agent, respectively;

(c) subjecting the conditioned pulp slurry to froth flotation to produce a froth containing beneficiated value minerals and a resultant pulp slurry containing said depressed hydrous, layered silicates; and (d) recovering the beneficiated value minerals from the froth.

2. A method according to claim 1 wherein the ore is a gold ore.

3. A method according to claim 1 wherein the collector is a xanthate.

4. A method according to claim 1 wherein the frother is triethoxybutane.

5. A method according to claim 1 wherein the ore is a nickel ore.

6. A method according to claim 1 wherein the ore is a platinum group metal ore.

7. A method according to claim 1 wherein the hemicellulose is derived from bagasse.

* * * * *